US006409502B2

(12) United States Patent
Bury

(10) Patent No.: US 6,409,502 B2
(45) Date of Patent: Jun. 25, 2002

(54) GAS BURNERS FOR HEATING A GAS FLOWING IN A DUCT

(75) Inventor: Frédéric Bury, Allauch (FR)

(73) Assignee: Entreprise Generale de Chauffage Industriel Pillard (FR)

( * ) Notice: Subject to any disclaimer, the term of this patent is extended or adjusted under 35 U.S.C. 154(b) by 0 days.

(21) Appl. No.: 09/775,918

(22) Filed: Feb. 2, 2001

(30) Foreign Application Priority Data

Feb. 4, 2000 (FR) ..... 00 01455

(51) Int. Cl.[7] ..... F23D 14/46

(52) U.S. Cl. ..... 431/350; 431/171; 431/351; 431/354

(58) Field of Search ..... 431/350, 354, 431/353, 171, 202, 351, 284, 285, 116; 432/222

(56) References Cited

U.S. PATENT DOCUMENTS

| | | | | |
|---|---|---|---|---|
| 3,494,712 A | * | 2/1970 | Vosper et al. | 431/350 |
| 3,649,211 A | | 3/1972 | Vosper | |
| 3,843,309 A | * | 10/1974 | Lambiris | 431/350 |
| 4,375,952 A | * | 3/1983 | Vosper et al. | 431/171 |
| 4,523,905 A | * | 6/1985 | Lewis | 431/351 |
| 4,767,319 A | * | 8/1988 | Vosper | 431/350 |
| 4,895,514 A | | 1/1990 | Cantryn et al. | |

FOREIGN PATENT DOCUMENTS

| | | |
|---|---|---|
| DE | 38 30 038 | 3/1990 |
| EP | 0 654 637 | 5/1995 |
| EP | 0 313 469 | 4/1999 |
| JP | 62-123208 | 6/1987 |

* cited by examiner

*Primary Examiner*—James C. Yeung
(74) *Attorney, Agent, or Firm*—Bachman & LaPointe, P.C.

(57) ABSTRACT

The technical field of the invention is that of making "in-stream" burners which are placed directly inside a duct carrying a flow of gas, with the burners serving to heat the gas and being placed as burner rails that are generally made up of individual blocks. Such burners comprising a pipe on an axis XX' and suitable for extending transversely across the flow direction of the gas, the pipe being fed with a fuel gas and being pierced by at least two holes in alignment on a common generator line, the burner also having a flame stabilizer formed by two deflector-forming fins diverging on either side of the generator line. According to the invention, at least one of the holes is extended by a tube extending beyond the outer edges of the fins and pierced by at least one fuel gas ejection orifice at its distal end.

12 Claims, 5 Drawing Sheets

GAS BURNERS FOR HEATING A GAS FLOWING IN A DUCT

FIELD OF THE INVENTION

The present invention relates to an improvement to gas burners for heating a gas flowing in a duct.

The technical field is making "in-stream" burners which are placed directly inside a gas flow duct, which burners are disposed as a rail generally made up of individual blocks and extending transversely across the gas flow direction.

In the present description, the term "burner" is used both to cover a rail made up of a plurality of individual blocks, and an individual block on its own.

The main applications of the invention are in heating turbine gas in co-generator installations. A "post-combustion" burner serves to improve the overall efficiency of the installation, to modulate the production of steam as a function of requirements, and, as a by-product, also serves to maintain such production in the event of the gas turbine stopping. Under such circumstances, a fan sucks in ambient air and delivers the oxygen required by the burners instead of and as a replacement for the exhaust gas from the turbine.

BACKGROUND OF THE INVENTION

Burners must be capable of operating with a flame that is stable under conditions that are very different, i.e. with turbine gas at a temperature of 300° C. to 600° C. having 11% to 15% oxygen, or with ambient air. An example of a burner of this type is described in European patent 0 313 469 published on Apr. 23, 1989 in the name of Mécanique Générale Foyers Turbine.

French regulations concerning emissions from installations of this type have recently been extended by an Aug. 11, 1999 Order issued by the French Environment and Planning Ministry limiting emissions of nitrogen oxides and carbon oxides. For boilers used in post-combustion, the specified values are: a maximum of 200 milligrams per standard cubic meter ($mg/Nm^3$) for nitrogen oxides, NOx, and 250 $mg/Nm^3$ for carbon oxides, CO.

Burners of the kind described in the above-cited European patent enable that order to be complied with while operating with turbine gas. However, even though certain devices are described in that patent for reducing nitrogen oxide emissions, they cannot in most cases achieve the values required by the regulations when operating post-combustion in ambient air.

OBJECTS AND SUMMARY OF THE INVENTION

The problem posed is thus to be able to make an "in-stream" burner operate while complying with the above values set by regulations and simultaneously preserving good flame stability.

A solution to the problem posed is a burner of conventional type which can be placed in a duct to heat a gas flowing in the duct. The burner comprises a pipe suitable for being placed transversely across the flow direction of the gas. The pipe is fed with fuel gas and is pierced by at least two holes that are in alignment on a common generator line thereof. The holes optionally are fitted with injectors and enable jets of fuel gas to be ejected in the downstream direction. The pipe carries a flame stabilizer formed by two deflector-forming fins diverging on either side of the generator line and serving to deflect the flow of oxidizing gas so as to create a protected zone in which flame can develop downstream from the burner rail.

According to the invention, at least one of the holes is extended by a tube extending beyond the outside edges of the fins and pierced by at least one fuel gas ejection orifice at its distal end.

Such a tube injects a portion of the fuel gas, for example at a distance of at least 100 millimeters (mm) downstream from the other orifices not fitted with tubes, thereby enabling the injection of the gas to be staged and enabling the resulting combustion flames to be staged, thus reducing the percentage of nitrogen oxides, NOx, that is produced. The main flame obtained by this staged injection, i.e. the flame which is further from the deflector stabilizer, is thus more aerated. Combustion thus takes place with a greater excess of air and therefor at a lower temperature, thereby producing a great reduction in the formation of those nitrogen oxides that are essentially of thermal origin. The greater the staging, the greater the extent to which nitrogen oxides are reduced.

Such a method of reducing nitrogen oxides, NOx, by staging the gas is already taught in the above-cited patent application EP 0 313 439; however, the tubes are mentioned therein only as being optional and they are situated outside the blocks making up the burner, with the ends of the tubes being situated in approximately the same plane as the leading edges of the fins of the stabilizer, and outside it.

The major drawback of that disposition is that the quantity of carbon monoxide, CO, that is formed is well above the limit allowed by the above-specified Order. This formation is due to the excessive distance between the flame which develops in the shelter of the stabilizer fins and the injection of secondary gas having a portion that is highly diluted by air and which therefore does not burn or does not burn completely.

Amongst other things, the present invention enables that defect to be remedied. The principle whereby the NOx is reduced remains that of staging the gas, but, in this case, the staging takes place axially instead of radially. To avoid forming CO, it suffices to maintain a sufficient flow rate (less than 30% of the total flow rate of the fuel gas) via the conventional orifices without tubes so as to create a pilot flame which ensures that the main flame coming from the staged injection ignites and is stable.

In a preferred implementation for improving aeration of the staged main flame, the distal end of the tube has at least four different ejection orifices. The gas can then be ejected through these various orifices at different angles, instead of being ejected through a single orifice on the axis of the tube. In the embodiment described and shown in the accompanying figures, the ejection axes of the orifices are inclined in pairs, firstly by an angle $\beta$ of 20° to 50° on either side of the plane defined by the generator line on which the holes are in alignment and the axis of the pipe, and secondly, by an angle $\alpha$ of 10° to 30° on either side of the plane orthogonal to the preceding plane and containing the hole extended by the tube. The angles $\alpha$ and $\beta$ are important in determining the quality of the results. They must be determined as a function of the dimensions of the burner and of the hearth on which it is mounted.

In addition, in order to be able to further improve this staging effect by reducing the primary flow rate, it is possible to conserve the stability of the main or "secondary" flame since it achieves fuel gas staging with only 10° of the gas in the primary orifices thus not having a tube. For this purpose, in accordance with the invention, it is possible to introduce a portion of the oxidizing gas at the root of the secondary flame. In addition to increasing the stability of the flame during turbine gas operation, this technique also has the advantage of reducing nitrogen oxide NO contained in the gas by the so-called "reburning" effect (where NO is transformed into $N_2$ by chemical reduction coming from the $CH^+$ radicals present at the root of the flame). It is also possible to add at least one obstacle placed facing at least one gas jet ejected by one of the holes that is not extended by a tube, thereby encouraging them to expand and enlarge the pilot flame, which is also referred to as the "primary" flame, so as to impart better efficiency thereto.

Various shapes can be given to the obstacle, such as the preferred cylindrical shape. However, other shapes can also be used to similar effect.

The other characteristics of burners or burner rails as described in above-cited patent EP 0 313 469 can likewise be combined with those of the present invention described above and below in order to obtain a burner that also ensures a practically constant aeration rate for the air-and-fuel mixture in spite of variations in the fuel flow rate and/or in the speed of the gas to be heated. Such additional characteristics are described below and shown in some of the figures.

The result are novel gas burners for heating a gas flowing in a duct. The novel gas burners include improvements to presently known burners since they solve the same problem, which is that of complying with the values set by regulations concerning nitrogen oxide NOx and carbon oxide CO emissions, while ensuring good flame stability and an aeration rate that is practically constant in the air-and-fuel mixture regardless of variations in the fuel flow rate and/or in the speed of the gas to be heated.

BRIEF DESCRIPTION OF THE DRAWINGS

Such results demonstrate the novelty and the advantage of the present invention without it being necessary to cite further advantages. The description and the accompanying drawings show embodiments of the invention having no limited character. Other embodiments are possible in the context of the ambit and the scope of this invention, in particular changing the shape of the fuel feed pipe and also that of the stabilizing deflector, and varying the number of fuel injection holes or orifices, which can, for example, lie in the range of 2 to 10.

In the figures.

DETAILED DESCRIPTION OF PREFERRED EMBODIMENT(S)

Figure 1:
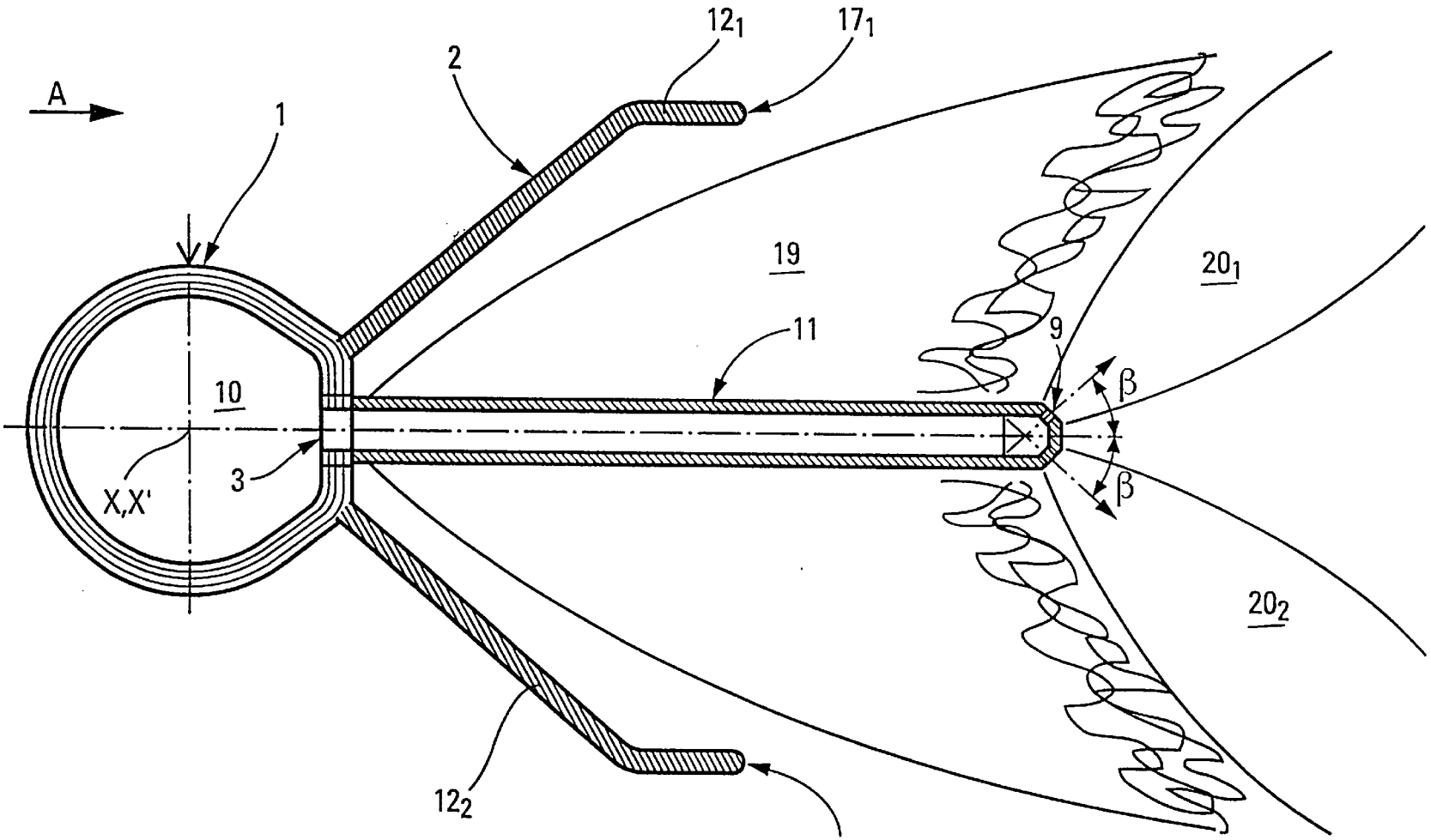
FIG. 1 is a sectional view of an embodiment of a burner of the invention perpendicularly to the axis of its fuel gas feed pipe.
Figure 2:
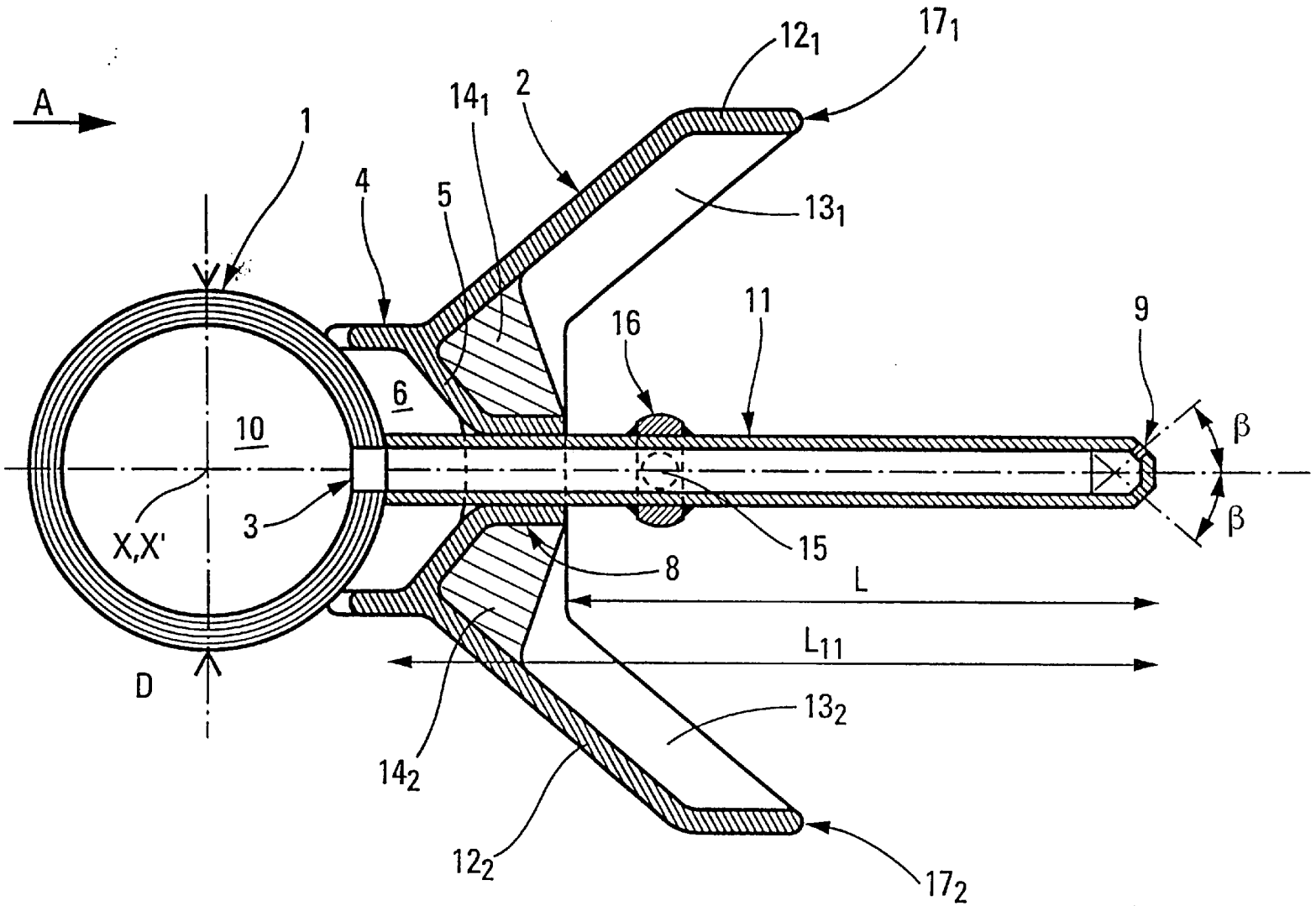
FIG. 2 is a sectional view taken along lines II-II' of FIG. 3 showing another embodiment of a burner of the invention.

The invention relates to a type of burner to be placed in a duct to heat a gas flowing along the duct. The burner comprises a pipe 1 of axis XX' suitable for extending transversely across the flow direction A of the gas. The pipe can be circular in section and have a diameter D, as shown in FIG. 2, but it could equally well be arbitrary in section, for example, having a section as shown in FIG. 1. It can carry a plurality of burner blocks placed side by side to make up a burner rail.

The pipe 1 is fed with fuel gas 10 and is pierced by at least two holes 3 per burner block with the two holes being in alignment on a common generator line 18 which is parallel to the axis XX' of the tube. The pipe 1 carries a flame stabilizer 2 formed by two deflector-forming fins 12 diverging on either side of the generator line 18.

In the embodiments shown in FIGS. 2 to 5, the deflector stabilizer 2 can have walls $\mathbf{13}_1$, $\mathbf{13}_2$, forming reinforcing ribs at the ends, along the direction of the axis XX' of the fins 12 of each burner block, and also intermediate ribs $\mathbf{14}_1$, $\mathbf{14}_2$ when the burner block has a plurality of holes 3 and therefore requires intermediate reinforcement of the fins 12. The fins can also have a gap 22 towards their outer edges 17 downstream relative to the flow direction A of the oxidizing gas flow so as to stiffen the edges and improve the aerodynamics of the burner block.

In the invention, at least one of the holes 3 is extended by a tube 11 which extends beyond the outer edges 17 of the fins 12 and which is pierced by at least one orifice 9 for ejecting the fuel gas 10 from its distal end.

As shown in FIG. 1, at least one "conventional" orifice 3 that does not have a tube serves to obtain a "pilot" or "primary" flame 19 for ensuring ignition and stability of at least one main or "secondary" flame 20 coming from the staged injection.

Since the stability of this secondary flame 20 can be conserved with only 10% of the fuel gas passing through the primary orifices 3, because of devices of the kind described below, the Venturi pre-mixing system using a converging-diverging nozzle 8 as shown in FIG. 2 and as described in European application EP 0 313 469 is not essential for proper operation of the burner. The present invention thus applies to all types of "in-stream" burners having a deflector stabilizer, whether or not they include such a Venturi device.

The distal end of the tube 11 preferably has one or more diverging ejection orifices 9 having ejection axes which are inclined at an angle $\beta$ relative to the plane AA' defined by the generator line 18 on which the holes 8 are aligned and the axis XX' of the pipe 1, and at an angle $\alpha$ about the plane BB' perpendicular to the preceding plane and containing the hole 3 as extended by the tube 11.

The number of orifices, their ejection angles $\alpha$ and $\beta$, and their flow diameters are functions of the speed of the oxidizing gas and of the dimensions of the duct in which the burner is placed (and thus of the distance between the blocks making it up), for the purpose of adapting and optimizing the penetration of fuel jets into the oxidizing gas stream. For this purpose, the distal end 25 of the tube 11 can be interchangeable and held in place by a threaded or other system.

When there are four ejection orifices 9, for example, their axes can be inclined in pairs at an angle $\beta$ lying in the range of 20° to 50° on either side of the plane AA', and at an angle $\alpha$ lying in the range of 10° to 30° on either side of the plane BB'.

To obtain stability in the main or "secondary" flame 20 while using only 10% of the fuel gas in the primary orifices 3, and to avoid CO being formed during operation with turbine gas, the burner of the invention includes optionally, an obstacle 15 placed facing one of the holes 3 that is not extended by a tube 11 so as to encourage the fuel gas jet ejected thereby to expand, thereby broadening the primary flame so as to impart better efficiency thereto; and openings 21 beyond the outer edges 17 of the fins as defined above and extended by complementary deflectors or ailerons 24, and made in the ailerons 24 at a level which is intermediate relative to the downstream edges 23 thereof in the oxidizing gas flow direction A. The openings 21 allow a fraction of the oxidizing gas to pass which is then introduced to the root of the secondary flame 20, thereby providing more progressive feed thereto and enabling the NO content in the oxidizing gas to be reduced.

Figure 5:
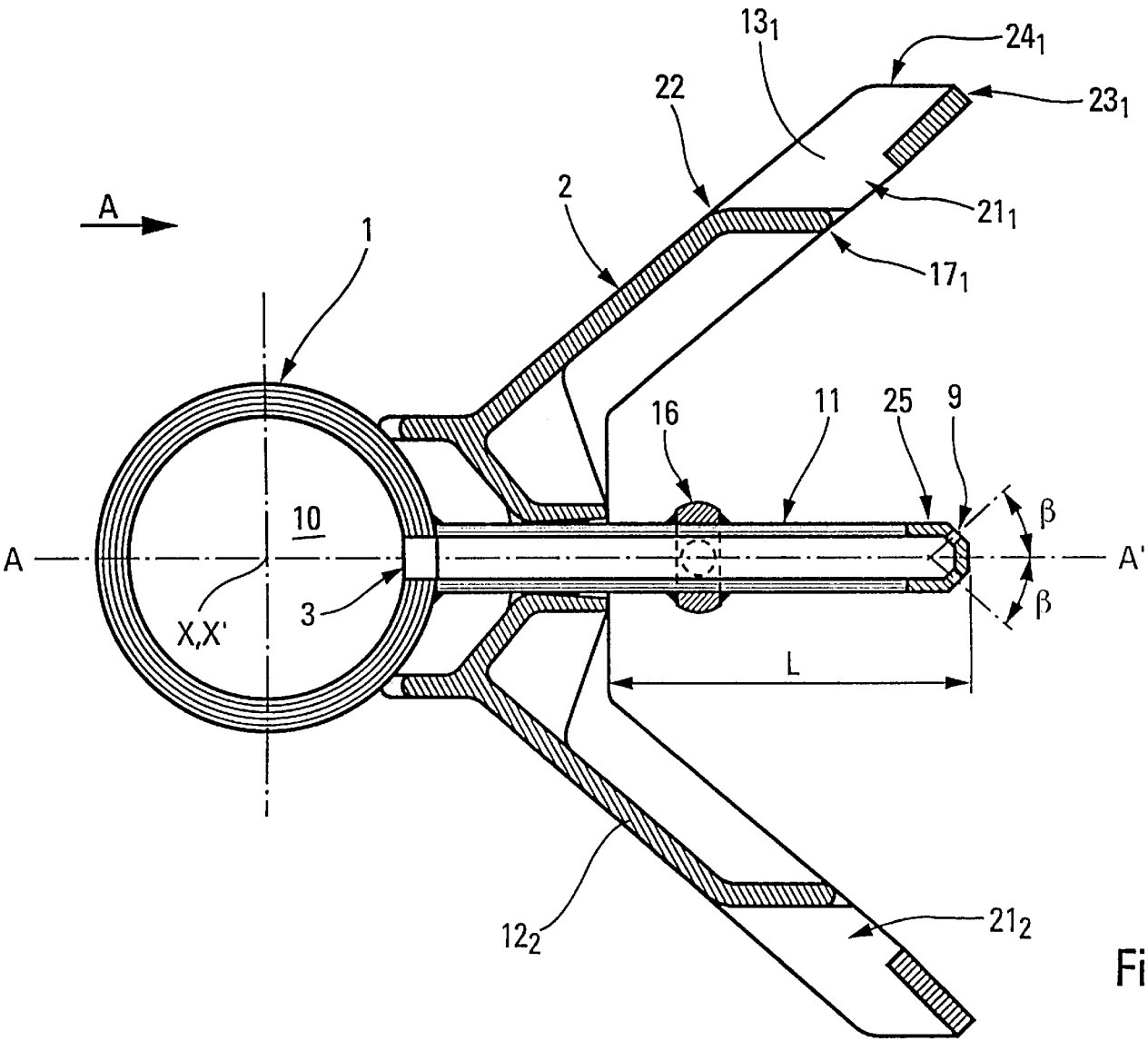
FIG. 5 is a sectional view taken along lines II-II' of FIG. 3 showing an embodiment of a burner of the invention different from that of FIGS. 1 and 2.

In the embodiment of FIG. 5, a burner block of the kind shown in FIG. 2 can easily be modified by adding additional parts corresponding to the ailerons 24 placed beyond the gaps 22 in the fins 12 corresponding to the edges 17. The positions and the dimensions of the ailerons 24 have a significant effect on the results obtained. It is advantageous to be able to change them should that be necessary by making them in the form of separate fittings.

Figure 3:
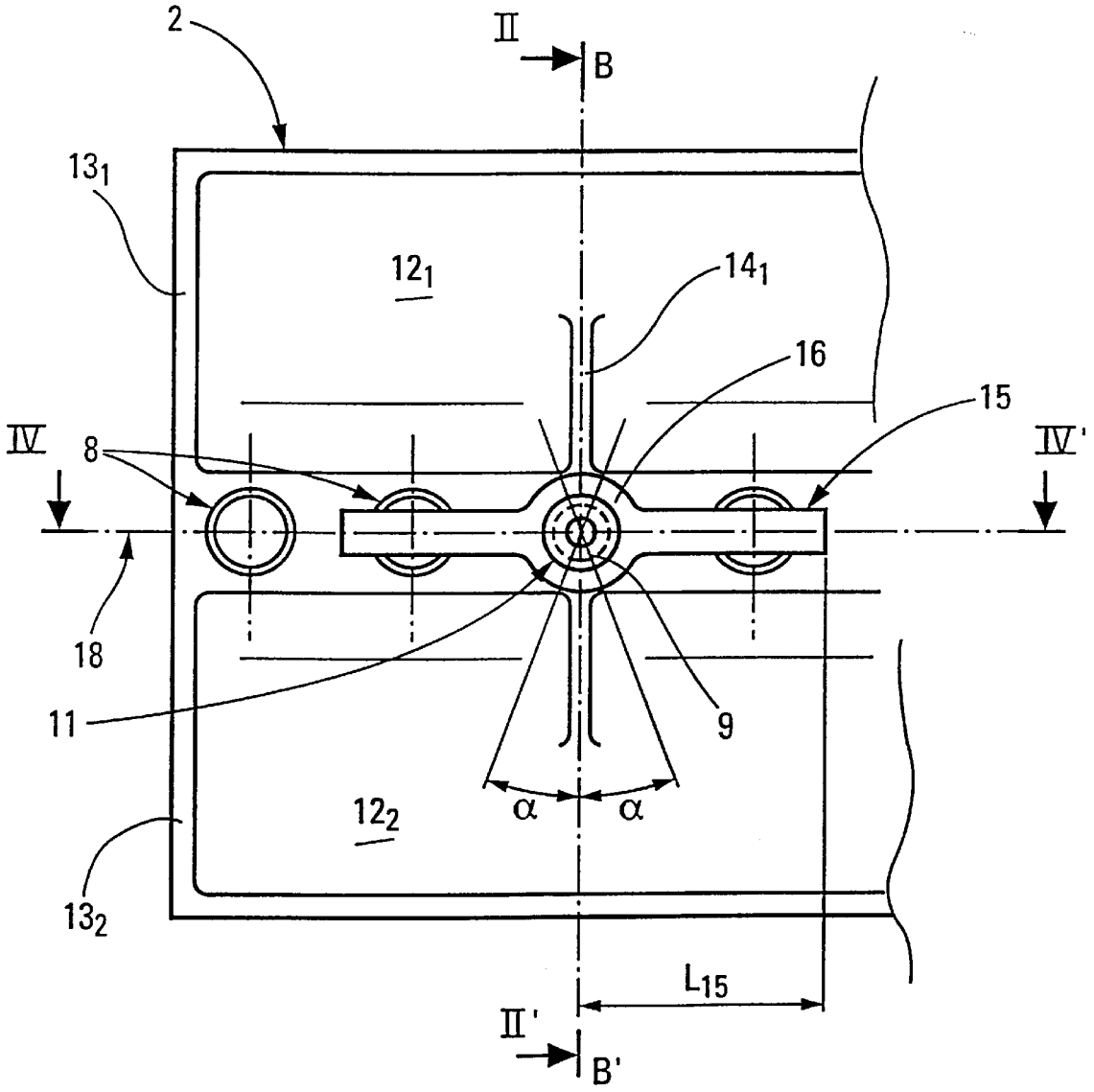
FIG. 3 is a front view facing the flow of gas to be heated, showing the burner of FIG. 2.
Figure 4:
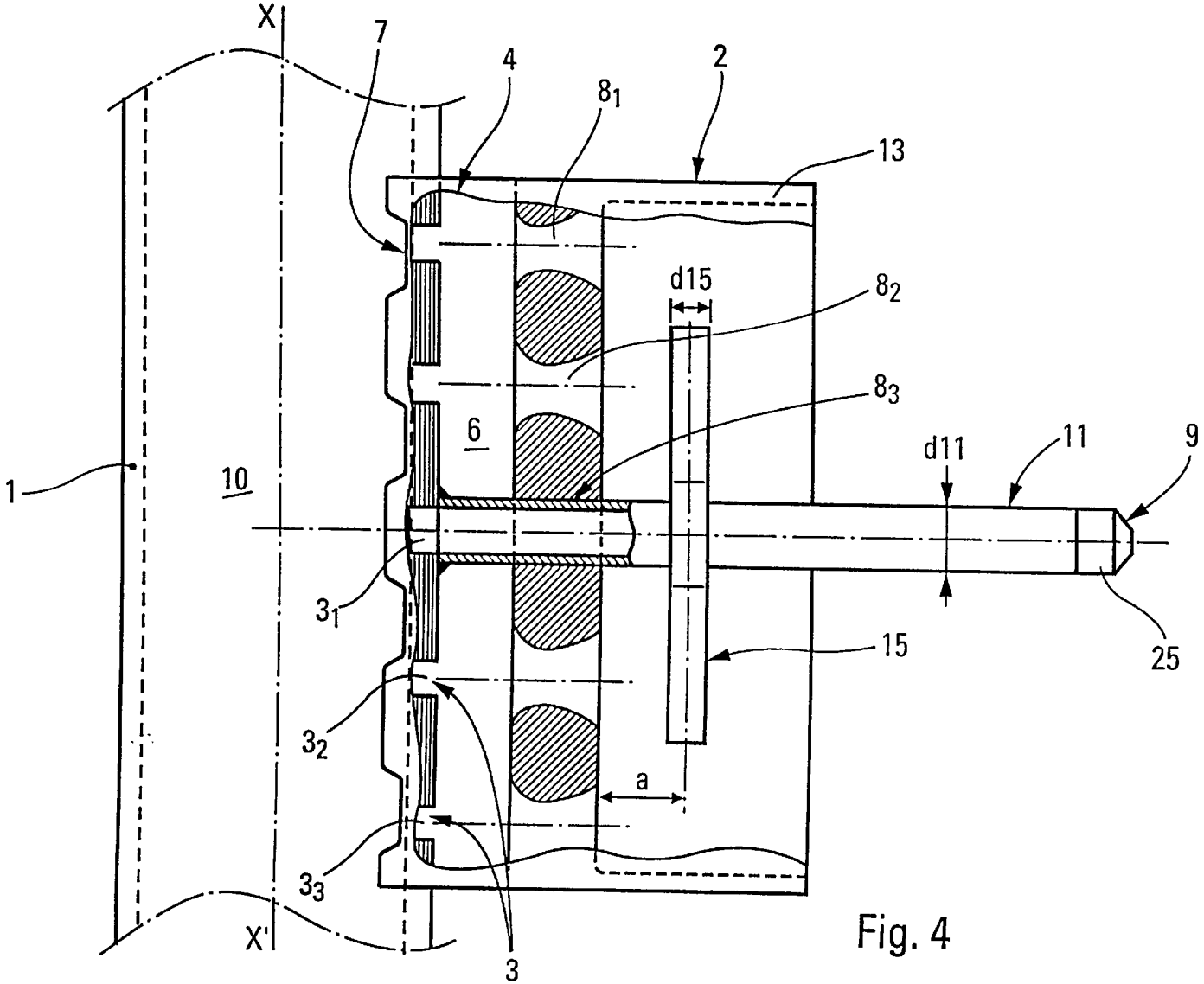
FIG. 4 is a sectional view taken along lines IV-IV' of FIG. 3 showing an embodiment of a burner of the invention.

As shown in FIGS. 2 to 4, the obstacle 15 that is optionally placed facing one of the holes 3 that is not extended by a tube 11 can be carried by a fixing ring or collar 16 on the tube 11 when the ejection holes or orifices 3 are placed on either side thereof. By way of example, the obstacle 15 can be cylindrical and its axis can be perpendicular to that of the hole 3 that it is placed to face.

In a given type of burner block, the block can have at least three holes 3, one of which, 3', is associated with the tube 11. The obstacle 15 is associated with one of the other holes 3' adjacent to the hole associated with the tube 11, while the last hole is left free.

A burner block can have an arbitrary number of holes, e.g. lying in the range of two to ten. The tubes 11 can be placed in regular manner, e.g. in every other hole, or one hole in three, or one hole in four, etc.

In the embodiment shown by way of example in FIG. 4, the burner block of the invention has five holes 3 with the tube 11 being associated with the central hole, the two holes adjacent thereto being associated with an obstacle 15, and the outermost two holes being free.

The burners of the invention can also have elements characteristic of burners of the kind described in patent EP 0 313 469. In particular, the burners can have a converging-diverging nozzle 8 placed in front of at least one of the holes $\mathbf{3}_2$ that is not extended by a tube 11, and placed coaxially therewith. The nozzle is suitable for ensuring that the gas jet ejected by the hole $\mathbf{3}_2$ creates suction at the inlet to the nozzle 8, as shown in FIG. 4. The inlet communicates with the outside face or back of at least one of the fins 12 of the stabilizer 2 via at least one opening 7.

The space between the nozzles 8 and the pipe 1 is closed firstly by two wall elements 4 fixed on the pipe and placed substantially parallel to the plane defined by the generator line 18 on which the holes 3 are aligned and by the axis XX' of the pipe 1, and secondly by a front wall 5 connected to the wall elements 4 and carrying the nozzles. The openings 7 are pierced through the wall elements 4.

As examples of particular embodiments, indications can be given concerning the dimensions of a burner block of the invention. The length $L_{11}$ of the tube 11 beyond the hole 3 with which it is associated is about 100 mm to 200 mm. The length L beyond the outlets form the nozzles 8 lying in the range of about 40 mm to about 150 mm, and preferably in the range of 50 mm to 80 mm for a diameter $d_{11}$ of 12 mm to 20 mm. The obstacle 15 can be a cylindrical tube of diameter $d_{15}$ of about 10 mm and placed at a distance a of about 25 mm from the outlets of the nozzles 8. The length $L_{15}$ of such obstacles fitted on the tube 11 can be about 85 mm to 90 mm depending on the distance between two adjacent holes 3. The diameter $D_1$ of the fuel feed pipe is about 85 mm to 90 mm.

What is claimed is:

1. A burner for placing in a duct to heat a gas flowing along said duct, the burner comprising a pipe on a first axis, said pipe extending transversely across a flow direction of said gas, the pipe being fed with fuel gas and being pierced by at least two holes in alignment on a common generator line, a flame stabilizer formed by two diverging deflector-forming fins with a first one of said fins being on a first side of said generator line and a second one of said fins being on a second side of said generator line, at least one of said holes being extended by a tube extending beyond outside edges of the fins, and said tube being pierced by at least one fuel gas ejection orifice at a distal end.

2. A burner according to claim 1, wherein the distal end of the tube can be interchangeable.

3. A burner according to claim 1, wherein the distal end of the tube has a plurality of diverging ejection orifices.

4. A burner according to claim 3, wherein the distal end has at least four ejection orifices on axes that are inclined at a first angle of 20° to 50° on either side of a first plane defined by the common generator line and by the first axis of the pipe, and at a second angle of 10° to 30° on either side of a second plane perpendicular to the first plane and containing the at least one hole that is extended by said tube.

5. A burner according to claim 1, having at least one obstacle placed facing one of the holes that is not extended by the tube.

6. A burner according to claim 5, wherein said obstacle is carried by the tube.

7. A burner according to claim 5, wherein said at least one obstacle is cylindrical and has an axis which is perpendicular to an axis of the hole which said at least one obstacle is to face.

8. A burner according to claim 5, further having at least three holes, the tube being associated with a first one of the holes and the at least one obstacle being placed facing a second hole adjacent to the first hole, and said third hole being free.

9. A burner according to claim 5, further having five holes with the tube being associated with a central hole, two holes adjacent said central hole being associated with an obstacle, and two outermost holes being free.

10. A burner according to claim 1, including ailerons extending outer edges of the fins, and openings in the ailerons for allowing a fraction of the gas flowing in the duct to pass through and be introduced towards a root of a flame of said burner.

11. A burner according to claim 1, including a converging-diverging nozzle in front of at least one of said holes that is not extended by a tube, the nozzle being coaxial with the at least one hole for ensuring that a jet of gas ejected by said at least one hole creates suction at an inlet to the nozzle, and said inlet communicating with an outside face of at least one of the fins of the stabilizer via at least one opening.

12. A burner according to claim 11, wherein a space between the nozzle and the pipe is closed by two wall elements which are fixed to the pipe and disposed substantially parallel to a plane defined by the generator line and the first axis, and by a front wall connected to said wall elements and carrying the nozzle, and wherein at least two openings are pierced through said wall elements.

* * * * *